US005217793A

United States Patent [19]

Yamane et al.

[11] Patent Number: 5,217,793

[45] Date of Patent: Jun. 8, 1993

[54] IMAGE RETRANSFERABLE SHEET FOR A DRY IMAGE-TRANSFERRING MATERIAL

[75] Inventors: Mitsuo Yamane, Yokkaichi; Takashi Kawaguchi, Nishikasugai, both of Japan

[73] Assignee: Brother Kogyo Kabushiki Kaisha, Aichi, Japan

[21] Appl. No.: 617,204

[22] Filed: Nov. 23, 1990

[30] Foreign Application Priority Data

Dec. 6, 1989 [JP] Japan ..... 1-318536
Dec. 6, 1989 [JP] Japan ..... 1-318538

[51] Int. Cl.[5] ..... B41M 5/26

[52] U.S. Cl. ..... 428/212; 428/195; 428/484; 428/913; 428/914

[58] Field of Search ..... 428/195, 202, 207, 484, 428/488.1, 488.4, 500, 520, 913, 914, 212

[56] References Cited

U.S. PATENT DOCUMENTS 4,555,436 11/1985 Geurtsen et al. ..... 428/914
4,778,729 10/1988 Mizobuchi ..... 428/484
4,927,278 5/1990 Kuzuya et al. ..... 400/208

*Primary Examiner*—Pamela R. Schwartz
*Attorney, Agent, or Firm*—Oliff & Berridge

[57] ABSTRACT

An image-retransferable sheet for dry image-transferring materials produced by heat-sensitive transfer is disclosed, which comprises a substrate having on one surface thereof, in sequence, a transferable release layer and a surface treating agent layer having a tensile strength of from 1 to 100 kg/cm$^2$.

18 Claims, 2 Drawing Sheets

IMAGE RETRANSFERABLE SHEET FOR A DRY IMAGE-TRANSFERRING MATERIAL

BACKGROUND OF THE INVENTION

The present invention relates to an image-retransferable sheet for a dry image-transferring material capable of transferring an image such as letters, signs, figures or the like onto the surface of a desired substance by applying pressure to the image-transferring material whose imagebearing surface is brought into contact with the surface of the substance (hereafter referred to as "pressure-sensitive retransfer"). More specifically, it relates to an imageretransferable sheet of such a dry image-transferring material produced by thermally printing or transferring an image on the sheet with a thermally transferring type printing device such as a printer, a typewriter, a word processor or the like (hereafter referred to as "heat-sensitive transfer").

As base sheet (image-retransferable sheets) for dry image-transferring materials produced by heat-sensitive transfer, Japanese Patent Application No. sho-61-275537 discloses films of polyethylene, polypropylene, fluorine-containing resins, etc., or silicone resin-coated sheets of paper, metal foils, plastic films, etc., which have a smooth surface and exhibit a water-contact angle of at least 95 degree.

In formation of an ink image on such a base sheet having a water-contact angle of 95 degree or more (particularly 105 degree or more) by heat-sensitive transfer, an ink temperature is necessarily increased to reduce surface tension of the ink and wet the surface of the base sheet to an extent that adhesion of the ink to the base sheet becomes larger than cohesive force of the ink and adhesion of the ink to an ink-donating base film such as PET. Thus, a high thermal energy is required for the image formation, and it is very disadvantageous to heat-sensitive transferring devices concerning durability of a thermal head and load to an electric source.

Further, ink images formed on such a surface of poor wettability are easily retransferred merely with little pressure applied thereto because of its poor adhesion to the surface so that, upon retransfer of certain portions of the images, the other portions of the images are undesirably retransferred and stain the intended images. Mere touch in handling of the image-formed sheet often removes the images therefrom.

Furthermore, when the base sheet having a thermally transferred ink image is subjected to pressure-sensitive retransfer, the sheet is not easily fixed on an image-receiving substance since it has an extremely small coefficient of static friction, resulting in retransfer of imperfect images getting out of position or with distortion.

In order to prevent the base sheet from slipping, it is described in Japanese Patent Application No. sho-62-80127 to provide a sticky layer apart from thermally transferred images on the base sheet. However, an additional means is required to provide such a sticky layer at predetermined portions of the base sheet, and a device for the above purpose is needed. Further, the sticky layer has to be covered with a separable sheet, etc. before use, requiring further additional means and costs. In the case of using a silicone resin-coated sheets as a base sheet as described above, two layers, i.e., the silicone resin layer and the sticky layer must be provided and it may well be that one of the two layers previously coated has influence on the other. That is, when a silicone resin is first coated on a sheet, a sticky material is repelled when coated on the silicone resin layer. When the sticky material is first coated at portions of a sheet, its stickiness makes it difficult to coat the silicone resin on the sheet. Even if a separable sheet is provided on the sticky layer, difficulty in coating of the silicone resin cannot be eased because of the increased thickness at the sticky layer-formed portions. Even with the two layers properly coated, fixation of the sheet is yet insufficient as the sticky layer exists only in portions not fully surrounding areas to which thermally transferred images are provided.

In any case, a surface treating agent like a silicone resin coated on a conventional base sheet is not transferred with an ink image but left as it is, and it functions to ensure improved releasability of the ink image from the sheet. Therefore, the surface treating agent has hitherto been selected or formulated to have the property of reducing wettability of the sheet and decreasing adhesion of the ink image to the sheet, which property, however, deteriorates the image-receiving property and image-rubbing resistance of the sheet and necessitates a high thermal energy for heat-sensitive transfer.

SUMMARY OF THE INVENTION

The first object of the present invention is to provide an image-retransferable sheet which can be easily fixed upon pressure-sensitive retransfer.

The second object of the present invention is to provide an image-retransferable sheet capable of retaining an ink image thereon even when rubbed slightly or applied low pressure, i.e., having good image-rubbing resistance.

The third object of the present invention is to provide an image-retransferable sheet capable of being thermally transferred (printed) an image with good image quality merely by application of low thermal energy.

The fourth object of the present invention is to provide an image-retransferable sheet capable of completely retransferring a thermally transferred image onto an imagereceiving substance with no residual ink on the sheet.

The fifth object of the present invention is to provide an image-retransferable sheet which makes it easy to confirm whether a thermally transferred image on the sheet has been retransferred to an image-receiving substance.

The sixth object of the present invention is to provide an image-retransferable sheet capable of forming an image having improved rubbing resistance on an image-receiving substance by pressure-sensitive retransfer.

The seventh object of the present invention is to provide an image-retransferable sheet allowing a choice of surface treating agent from a wide range yet causing no problems in coating of the surface treating agent and providing good pressure-sensitive retransferring property.

These objects of the present invention has been attained by an image-retransferable sheet comprising a substrate having on one surface thereof, in sequence, a transferable release layer and a surface treating agent layer having a tensile strength of from 1 to 100 kg/cm$^2$.

In the figures, 10 is an image-retransferable sheet having an ink image formed thereon (i.e., a dry image-transferring material), 11 is a substrate, 12 is a transferable release layer, 13 is a surface treating agent layer, and 14 is an ink image.

DETAILED DESCRIPTION OF THE INVENTION

Figure 1:
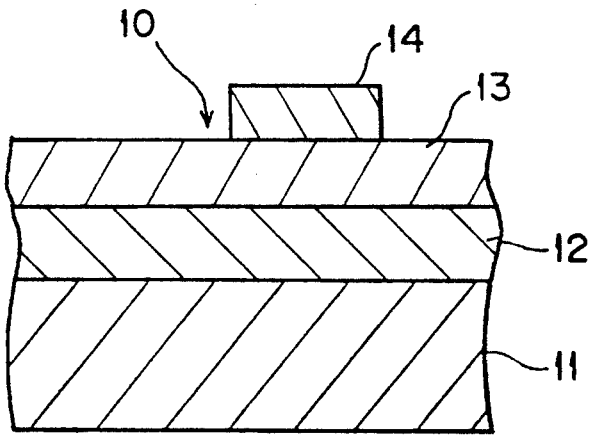
FIG. 1 illustrates a sectional view of an image-retrans-ferable sheet of the present invention.

As shown in FIG. 1, the image-retransferable sheet of the present invention comprises substrate 11 having on one surface thereof, in sequence, transferable release layer 12 and surface treating agent layer 13.

The substrate which can be used in the present invention generally has a thickness of from 25 to 200 micron and preferably from 50 to 150 micron. It is desired that the substrate possesses not only sufficient mechanical strength for production of the sheet but also flexibility to an extent that pressure can be easily applied to an image-bearing surface of the sheet upon pressure-sensitive retransfer and also that heat-sensitive transfer can be easily effected on the sheet to produce a dry image-transferring material. Substrates having a large elongation are not preferred because they are elongated by the applied pressure upon pressure-sensitive retransfer, resulting in distortion of a retransferred image on an image-receiving substance. In this regard, the elongation is preferably not more than 200%.

To ensure perfect retransfer of an image by pressuresensitive retransfer, the substrate is preferably transparent or semitransparent. In particular, semitransparent substrates are preferred since it is easy to check whether the image has completely been retransferred or not.

As a substrate, there may be used plastic films, paper, metal foils and the like. Examples of plastic films include films of polyethylene, polypropylene, fluorine-containing resins such as ethylene-tetrafluoroethylene copolymer and tetrafluoroethylene-hexafluoroethylene copolymer, polyethylene terephthalate, nylon, polyimide, polyvinyl chloride, polycarbonate, polysulfone, ethylene-vinyl acetate copolymer, acrylonitrile-butadiene-styrene copolymer, ionomers or the like.

Transferable release layer 12 formed on one surface of substrate 11 is composed of one or more waxes such as vegetable waxes (e.g., candelilla wax, carnauba wax and rice wax), animal waxes (e.g., bees wax and lanolin), mineral waxes (e.g., montan wax and ceresine), petroleum waxes (e.g., paraffin wax and microcrystalline wax), synthetic waxes (e.g., Fischer-Tropsch wax and polyethylene wax) or the like. Transferable release layer 12 has a thickness of from 0.5 microns to 20 microns, more preferably from 1 micron to 10 microns, and has cohesive force of from 1 kg/cm$^2$ to 100 Kg/cm$^2$.

Resins such as polyethylene, ethylene-vinyl acetate copolymer, celluloses, ionomers, polyvinyl alcohol and the like may be added to the transferable release layer so as to adjust the cohesive force, adhesion and strength of the layer.

Figure 2A:
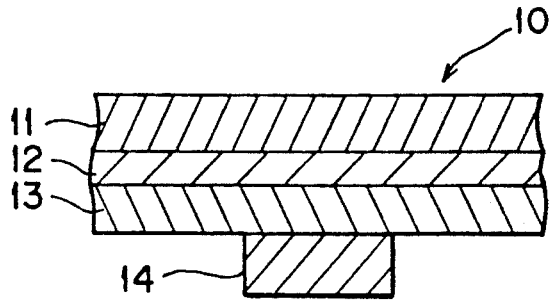
FIGS. 2 (*a*), (*b*) and (*c*) illustrate states in series of pressure-sensitive retransfer of an ink image using an image-retransferable sheet of the present invention.
Figure 2B:
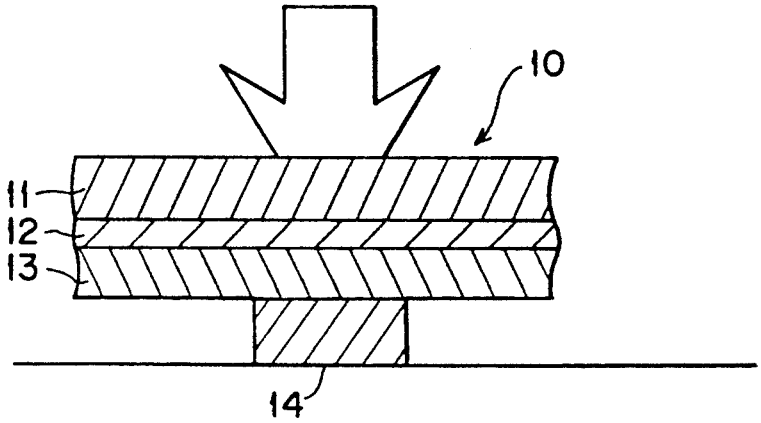
Figure 2C:
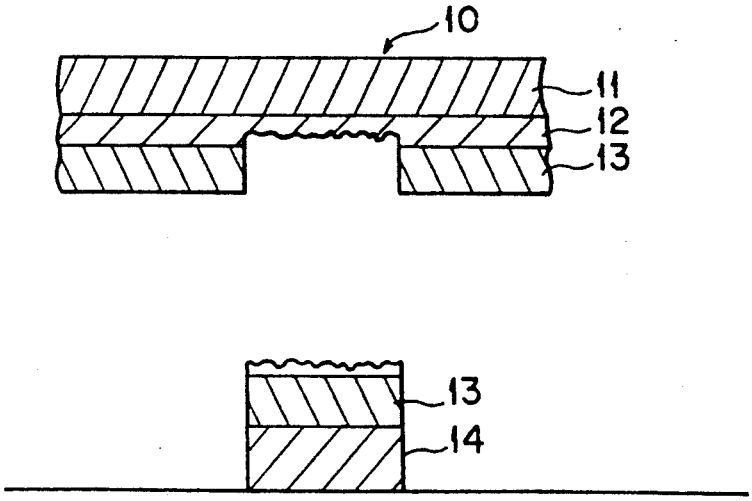

Transferable release layer 12 has a smaller cohesive force than surface treating agent layer 13 and ink image 14, so that cohesive failure takes place in transferable release layer 12 upon pressure-sensitive retransfer as shown in FIG. 2 (*c*), attaining easy retransfer of the ink image.

The transferable release layer enables one to use surface treating agents which cannot be used for the reason of high adhesion to the substrate and poor releasability, in other words, allowing a choice of surface treating agent from a wide range since the releasability of the surface treating agent layer no longer needs to be considered. Further, the pressure-sensitive retransferring property can be markedly improved with the transferable release layer. As being different from a conventional release layer, the transferable release layer exhibits good wettability to the surface treating agent, and thus the image-retransferable sheet of the present invention is free from problems in coating of the surface treating agent such as repelling of the agent.

The transferable release layer is preferably transparent so as not to change the viewed color of retransferred images.

Surface treating agent layer 13 which is coated on transferable release layer 12 has a tensile strength of from 1 to 100 kg/cm$^2$, so that an ink image formed on the image-transferable sheet can be retransferred together with the underlying surface treating agent from the sheet to an image-receiving substance. If the tensile strength exceeds 100 kg/cm$^2$, the resulting surface treating agent layer exhibits too high cohesive force to be transferred. If it is less than 1 kg/cm$^2$, the layer strength is so small that the resulting layer is peeled off when the sheet is bent. The surface treating agent layer 13 has a thickness of from 1 micron to 20 microns, more preferably from 1 micron to 10 microns.

The surface treating agent preferably has a melting point or softening point of at least 100 degree C and a melt viscosity at 100 degree C of at least 1000 poises. Use of a surface treating agent which has a melting point of less than 100 degree C or becomes too soft at that temperature causes failure in retransfer of a transferred image since the surface treating agent melt upon formation of the transferred image by heat-sensitive transfer.

With a surface treating agent layer having the tensile strength and melting point (or softening point) within the ranges as described above, an ink image which is formed on the layer by heat-sensitive transfer can be retransferred together with the surface treating agent. Thus, there is no particular limit on wettability of the surface treating agent layer. Therefore, a thermally transferred image can be formed on the layer with a low thermal energy, adhesion of the transferred image to the layer can be enhanced to improve the image-rubbing resistance of an image-retransferable sheet, and the coefficient of static friction of an image-retransferable sheet can be increased to prevent from being moved during pressure-sensitive retransfer, providing a retransferred image having good image quality on an image-receiving substance with ease.

Retransfer of a thermally transferred ink image together with the underlying surface treating agent provides further advantages. That is, the thermally transferred ink image can be completely retransferred without residual ink, it is easy to confirm completion of retransfer, and the retransferred image has high rubbing resistance as the surface treating agent on the image acts as a protective layer therefor.

Hitherto, a large image has been produced using a heat-sensitive transferring device having a small-serial thermal head by repeating heat-sensitive transfer of the large image line-by-line. Thus, a large image is formed by piecemeal. However, since each run of transfer has to be overlapped in parts of processed areas with a previous run, a previously transferred portion is often rubbed and removed upon the subsequent run. In order to avoid the undesired removal of the portions, heat-sensitive transfer is performed line-by-line to form on an image-retransferable sheet a large image divided into lines with leaving space between lines. In pressure-sensitive retransfer, such a divided large image is retransferred line by-line on an image-receiving substance in such a manner that the lines are united one after another. According to the present invention, however, such a complicated process can be omitted. Since the image-retransferable sheet of the present invention has relatively high adhesion, a previously transferred portion is not removed by a subsequent run of heat-sensitive transfer and a large image can be formed on the sheet without leaving space between lines.

Examples of surface treating agents used in the present invention include resins such as polyethylene, ethylene-vinyl acetate copolymer, vinyl chloride-vinyl acetate copolymer, polyvinyl butyral, celluloses, ethylene-ethyl acrylate copolymer, ethylene-acrylic acid copolymer, ionomers, ethylene-methacrylic acid coppolymer, polyvinyl alcohol, polyvinyl pyrrolidone and silicone, and waxes such as polyethylene wax, montan wax, Fischer-Tropsch wax and synthetic wax. They may be used independently or as a mixture of two or more. An amount of the wax is of from 40% to 98% by weight.

It is preferred that the surface treating agent layer contains a wax since use of wax makes it possible to finely control the tensile strength and to expand a range of choice with respect to surface treating agents, improving the retransferring property of the image-retransferable sheet.

In case the surface treating agent mainly comprises the aforesaid resins, the surface treating agent is preferably coated in the form of dispersion such as emulsions and suspension. If it is dissolved in a solvent or melted and coated on the substrate in the form of solution or hot melt, the tensile strength is extremely increased. In order to control the tensile strength or the adhesion of the surface treating agent layer, a filler may be added to the layer.

The surface treating agent layer thus formed is preferably transparent so as not to change the viewed color of retransferred images.

By the coating of the aforesaid surface treating agent, an image-retransferable sheet having improved properties can be obtained with respect to heat-sensitive transferring property, pressure-sensitive retransferring property, image-rubbing resistance upon handling, fixability upon pressure-sensitive retransfer and rubbing resistance of a retransferred image, as well as easy confirmation of completed retransfer.

For formation of transferred images on the image-retransferable sheet of the present invention by heat-sensitive transfer, an ink ribbon used in a conventional thermally printing device can be used, and it comprises an ink layer mainly of wax coated on a film such as PET film. It is preferred that the ink ribbon further comprises a transfer-controlling layer on the ink layer as an overcoat. The transfer-controlling layer has higher heat-sensitive adhesion, hardness, viscosity and cohesive force than the ink layer, and the layer markedly improves heat-sensitive transferring property even with an image-retransferable sheet of poor wettability. The transfer-controlling layer is transferred imagewise together with the ink layer by heatsensitive transfer and is retransferred with the ink image and the surface treating agent upon pressure-sensitive retransfer. It is also preferred to impart pressure-sensitive adhesiveness to the ink layer, whereby pressure-sensitive retransferring property of the resulting dry imagetransferring material is further improved.

The present invention is further explained below with reference to the following examples, but the present invention should not be construed as being limited thereto.

EXAMPLE 1

A transferable release agent having the following formulation was coated on a polyethylene terephthalate film having a thickness of 50 micron and dried at 80 degree C. On to the thus formed transferable release layer was coated a surface treating agent having the formulation also described below, followed by drying at 80 degree C, to obtain an image-retransferable sheet having a smooth surface and having a water-contact angle of 39 degree and a coefficient of static friction of about 0.42. The surface treating agent had a melt viscosity at 150 degree C of about 2000 to 4000 poises and the layer thereof had a tensile strength of about 20 kg/cm$^2$.

| | parts by weight |
|---|---|
| Formulation of Transferable Release Agent: | |
| Low molecular weight polyethylene ("Sanwax E-300", produced by SANYO CHEMICAL INDUSTRIES, LTD.) | 30 |
| Toluene | 70 |
| Formulation of Surface Treating Agent: | |
| Polyethylene ("Chemipearl M-200", produced by Mitsui Petrochemical Industries Ltd.) | 100 |

Then, an ink was thermally transferred imgewise onto the thus prepared image-retransferable sheet using a heat-sensitive transferring type word processor ("P-touch", produced by Brother Industries Co., Ltd.), whereby a dry image-transferring material having an ink image was obtained. In the heat-sensitive transfer, the image was formed with good image quality by application of a low thermal energy, as compared to the case of using a conventional image-retransferable sheet.

Using the dry image-transferring material, pressuresensitive retransfer was carried out onto paper and a plastic substance, and as a result, a retransferred image having good image quality was formed thereon. During the pressure-sensitive retransfer, the dry image-transferring material could be fixed in situ so that perfect retransfer could be done without any difficulty. Further, the surface treating agent was transferred together with the image, so that it was easy to confirm completion of the retransfer and the retransferred image covered with the surface treating agent exhibited good rubbing resistance.

EXAMPLE 2

Onto a nylon film having a thickness of 100 micron were formed a transferable release layer and a surface treating agent layer in the same manner as in Example 1, except using the following formulations, respectively. The thus obtained image-retransferable sheet had a smooth surface and had a water-contact angle of 76 degree and a coefficient of static friction of about 0.77. The surface treating agent had a melt viscosity at 150 degree C of about 5000 poises, and the layer thereof had a tensile strength of 15 kg/cm$^2$.

| | parts by weight |
|---|---|
| Formulation of Transferable Release Agent: | |
| Polyethylene wax ("Chemipearl W-200", produced by Mitsui Petrochemical Industries Ltd.) | 100 |
| Formulation of Surface Treating Agent: | |
| Ionomer ("Chemipearl SA-100", produced by Mitsui Petrochemical Industries Ltd.) | 100 |

Using the thus prepared image-retransferable sheet, a dry image-transferring material was prepared in the same manner as in Example 1, with which pressure-sensitive retransfer was then carried out. As a result, a retransferred image having good image quality was formed on an image-receiving substance.

EXAMPLE 3

A transferable release layer and a surface treating agent layer were formed on a polyethylene terephthalate film having a thickness of 50 micron in the same manner as in Example 1, except using the following formulations, respectively. Thus, an image-retransferable sheet having a smooth surface was prepared. The surface treating agent had a melting point of about 120 degree C, and the layer thereof had a tensile strength of about 20 kg/cm$^2$.

| | parts by weight |
|---|---|
| Formulation of Transferable Release Agent: | |
| Low molecular weight polyethylene ("Sanwax E-300", produced by SANYO CHEMICAL INDUSTRIES, LTD.) | 20 |
| Alkylolamide type surfactant ("Profan 2012E", produced by SANYO CHEMICAL INDUSTRIES, LTD.) | 4 |
| Water | 96 |
| Formulation of Surface Treating Agent: | |
| Polyethylene wax ("Chemipearl W-100", produced by Mitsui Petrochemical Industries Ltd.) | 90 |
| Ethylene-vinyl acetate copolymer ("Chemipearl V-300", produced by Mitsui Petrochemical Industries Ltd.) | 10 |

Using the thus prepared image-retransferable sheet, a dry image-transferring material was prepared in the same manner as in Example 1, with which pressure-sensitive retransfer was then carried out. In the heat-sensitive transfer and the pressure-sensitive retransfer, the same results as in Example 1 were obtained.

EXAMPLE 4

A transferable release layer and a surface treating agent layer were formed on a nylon film having a thickness of 100 micron in the same manner as in Example 1, except using the following formulations, respectively. Thus, an image-retransferable sheet having a smooth surface was prepared. The surface treating agent had a melting point of 109 degree C, and the layer thereof had a tensile strength of 10 kg/cm$^2$.

| | parts by weight |
|---|---|
| Formulation of Transferable Release Agent: | |
| Polyethylene wax ("Mitsui Hiwax 110P", produced by Mitsui Petrochemical Industries Ltd.) | 100 |
| Toluene | 90 |
| Formulation of Surface Treating Agent: | |
| Ionomer ("Chemipearl V-100", produced by Mitsui Petrochemical Industries Ltd.) | 100 |

Using the thus prepared image-retransferable sheet, a dry image-transferring material was prepared in the same manner as in Example 1, with which pressure-sensitive retransfer was then carried out. As a result, a retransferred image having good image was formed on an image-receiving substance.

COMPARATIVE EXAMPLE

An image-transferable sheet was prepared in the same manner as in Example 1, except that the transferable release layer was not formed on the polyethylene terephthalate film.

Using the image-transferable sheet, heat-sensitive transfer and pressure-sensitive retransfer were carried out in the same manner as in Example 1. It was found that the resulting dry image-transferring material was inferior to that of Example 1 in pressure-sensitive retransferring property. Namely, The dry image-transferring material was needed more pressure for longer processing time.

While the present invention has been described in detail and with reference to specific embodiments thereof, it will be apparent to one skilled in the art that various changes and modifications can be made therein without departing from the spirit and scope thereof.

What is claimed is:

1. An image-retransferable sheet for dry image-transferring material produced by heat-sensitive transfer, which comprises a substrate having on one surface thereof, in sequence, a transferable release layer and a surface treating agent layer having a tensile strength of from 1 to 100 kg/cm$^2$.

2. An image-retransferable sheet as in claim 1, wherein said transferable release layer is mainly composed of wax and has a lower cohesive force than the surface treating agent layer.

3. An image-retransferable sheet as in claim 1, wherein said surface treating agent layer contains a wax.

4. An image-retransferable sheet as in claim 1, wherein said surface treating agent has one of a melting point of at least 100° C., a softening point of at least 100° C., and a melt viscosity at 100° C. of at least 1000 poises.

5. An image-retransferable sheet as in claim 1, wherein said surface treating agent layer is formed using a dispersion of surface treating agent.

6. An image-retransferable sheet as claimed in claim 1, wherein said transferable release layer is one of transparent and semi-transparent.

7. An image-retransferable sheet for receiving an image and for retransferring the received image onto a desired image-receiving material, the image-retransfer sheet comprising:

a substrate, a transferable release layer formed on said substrate; and a surface treating agent layer formed on said transferable release layer, the surface treating agent layer having a tensile strength of from 1 to 100 kg/cm$^2$.

8. An image-retransferable sheet as claimed in claim 7, wherein said transferable release layer is mainly composed of wax and has a lower cohesive force than the surface treating agent layer.

9. An image-retransferable sheet as claimed in claim 7, wherein said surface treating agent layer contains a wax.

10. An image-retransferable sheet as claimed in claim 7, wherein said surface treating agent has one of a melting point of at least 100° C., a softening point of at least 100° C., and a melt viscosity at 100° C. of at least 1000 poises.

11. An image-retransferable sheet as claimed in claim 7, wherein said surface treating agent layer is formed using a dispersion of surface treating agent.

12. An image-retransferable sheet as claimed in claim 7, wherein said transferable release layer is one of transparent and semi-transparent.

13. An image-retransferable sheet for dry image-transferring materials produced by heat-sensitive transfer, the image-retransferable sheet comprising:

a substrate, a transferable release layer formed on said substrate, a surface treating agent layer formed on said transferable release layer, the surface treating agent layer having a tensile strength of from 1 to 100 kg/cm$^2$; and a discontinuous transferable image on a surface of the surface treating agent layer not adjacent said substrate, said transferable image for transfer to a further object by the application of pressure to a back side of said substrate.

14. An image-retransferable sheet as claimed in claim 13, wherein said transferable release layer is mainly composed of wax and has a lower cohesive force than the surface treating agent layer.

15. An image-retransferable sheet as claimed in claim 13, wherein said surface treating agent layer contains a wax.

16. An image-retransferable sheet as claimed in claim 13, wherein said surface treating agent has one of a melting point of at least 100° C., a softening point of at least 100° C., and a melt viscosity at 100° C. of at least 1000 poises.

17. An image-retransferable sheet as claimed in claim 13, wherein said surface treating agent layer is formed using a dispersion of surface treating agent.

18. An image-retransferable sheet as claimed in claim 13, wherein said substrate is one of transparent and semi-transparent.

* * * * *